US006553722B1

(12) United States Patent
Porret et al.

(10) Patent No.: US 6,553,722 B1
(45) Date of Patent: Apr. 29, 2003

(54) DEVICE FOR CONNECTING DOORS BETWEEN TWO CHAMBERS ISOLATED FROM THE EXTERNAL MEDIUM

(76) Inventors: Jean-Yves Porret, 2, rue de la Plaine, F-38610 Gieres (FR); Jean-Pierre Grimard, 14, rue du Nord, F-38450, Vif (FR); Claude Imbert, 10, chemin Concorde, F-38700 La Tronche (FR)

( * ) Notice: Subject to any disclaimer, the term of this patent is extended or adjusted under 35 U.S.C. 154(b) by 0 days.

(21) Appl. No.: 09/857,059

(22) PCT Filed: Dec. 9, 1999

(86) PCT No.: PCT/FR99/03078

§ 371 (c)(1),
(2), (4) Date: Jan. 29, 2002

(87) PCT Pub. No.: WO00/36610

PCT Pub. Date: Jun. 22, 2000

(30) Foreign Application Priority Data

Dec. 11, 1998 (FR) ..... 98 15851

(51) Int. Cl.[7] ..... E06B 3/00
(52) U.S. Cl. ..... 49/507
(58) Field of Search ..... 49/506, 507; 414/787

(56) References Cited

U.S. PATENT DOCUMENTS 4,508,750 A * 4/1985 Foll et al. ..... 427/44
5,892,200 A * 4/1999 Kendall et al. ..... 219/201

* cited by examiner

*Primary Examiner*—Jerry Redman
(74) *Attorney, Agent, or Firm*—David M. Fortunato

(57) ABSTRACT

This connecting device applies to a sealed connection device in which, firstly, each chamber, respectively a stationary chamber "A" and a transportable chamber "B" has at least one access opening equipped with a door (2, 3) cooperating with a flange (4, 5) with the interposition of sealing elements (12, 14), one (2) of the two doors being articulated to its flange (4), and secondly, the two doors (2, 3) have an element to lock their respective flanges (4, 5) and complementary connecting elements which allow them to be connected thereby forming, through contact of sealing elements (12, 16), an internal space "C" isolating their faces (17, 18) opposite each other from the external medium. The elements of connecting the two doors (2, 3) together comprise a network of ducts (30, 34, 35) formed at least in one of the doors and emerging, at one of its ends, from the external face (18) of the said door in the said sealed internal space "C", the said network being connected, at its other end, to a source (30) of vacuum.

3 Claims, 5 Drawing Sheets

FIG. 1
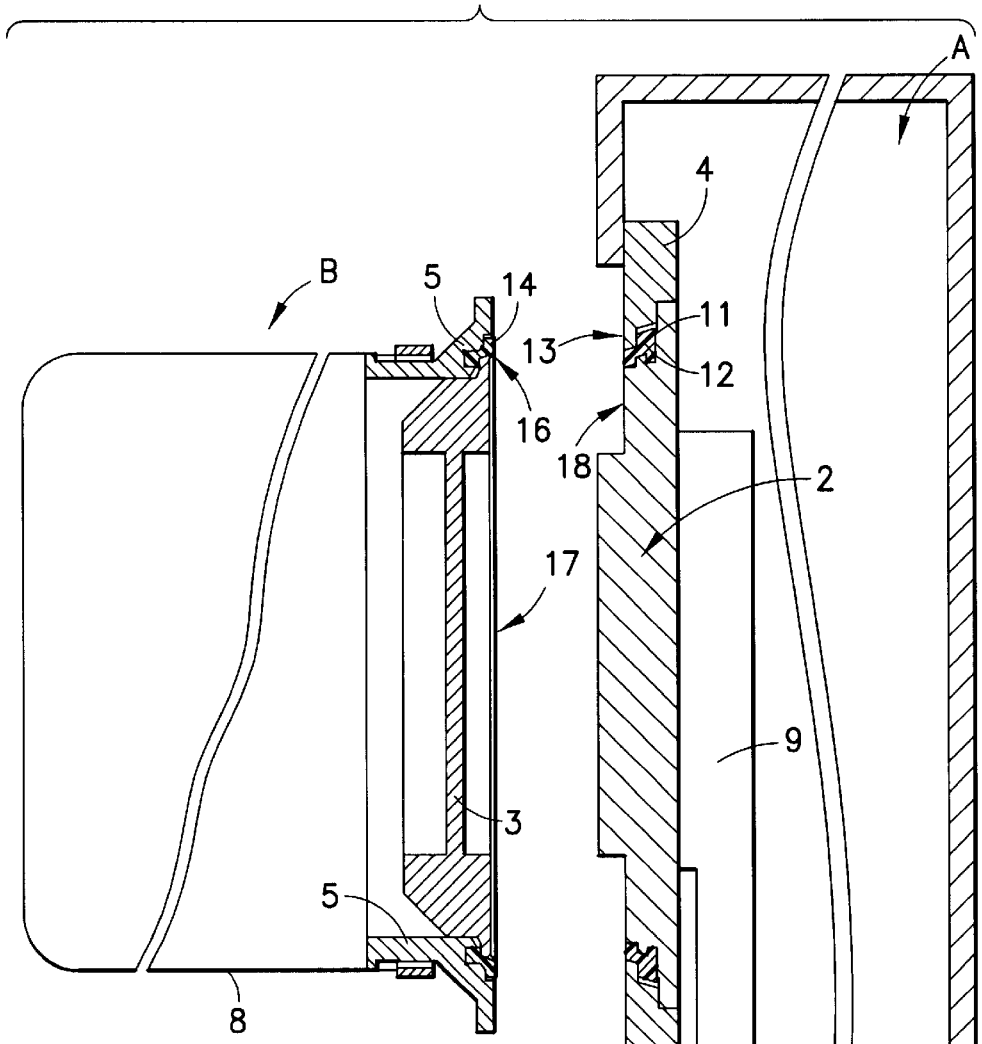
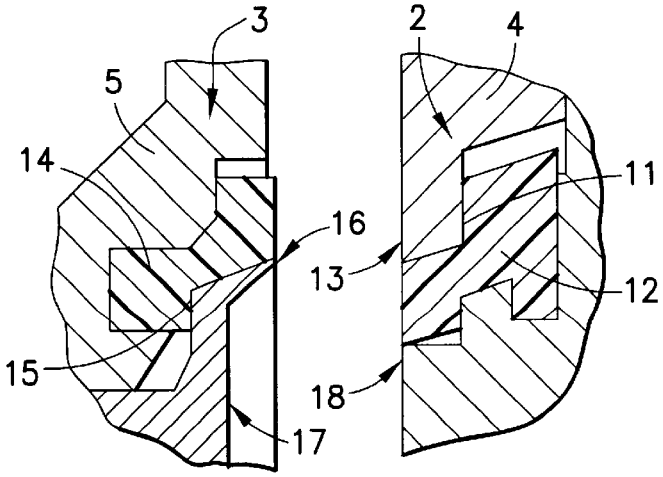
FIG. 2

DEVICE FOR CONNECTING DOORS BETWEEN TWO CHAMBERS ISOLATED FROM THE EXTERNAL MEDIUM

BACKGROUND OF THE INVENTION

The invention relates to a device for connecting doors in a device for the sealed connection of two chambers isolated from the external medium, with a view to transferring the contents from one of the chambers into the other chamber.

BRIEF SUMMARY OF THE INVENTION

For the purposes of this description, and of the interpretation of the appended claims, the terms "sealing" or "sealed" mean the characteristic whereby any wall separating two types of medium prevents or limits any transfer of one or more reference substances, for example so-called contaminating substances, through the said wall.

The terms "contaminating" or "contamination" mean the characteristic whereby a substance must remain excluded, or in a limited quantity or concentration, in a given medium. This may, for example, be a pathogen or polluting agent of biological or some other nature, but may also be simple solid, liquid or gaseous particles that can be placed in suspension in any fluid medium.

More specifically, although not exclusively, the present invention will be described hereafter with reference to an application of a medical or biological type, requiring any contamination, including by particles, from the external medium to be avoided or limited. By way of example, one of the chambers, hereafter called "A", consists of a clean room or sterile room but it may also be displaceable, and the other chamber, hereafter called "B" is removable and transportable, for example a disposable chamber, and contains one or more objects, or a charge to be transferred, when the sealed connection device described hereafter is in the coupled position, through the passage thus formed between the two chambers, namely from the transportable chamber to the stationary chamber, for example to supply the latter with components or products required for the manufacture or production in progress within the clean room or, conversely, to discharge waste or products from the said room.

BRIEF DESCRIPTION OF THE SEVERAL VIEWS OF THE DRAWINGS

The invention will be better understood with the aid of the description which follows with reference to the appended diagrammatic drawing, depicting, in FIGS. 1 to 7, a joining device according to the state of the art and, in FIGS. 8 to 11, one embodiment of the device according to the invention.

FIGS. 1, 3 and 4 are views in diametral section of a device for sealed connection between two chambers isolated from the external medium, respectively when the doors of the two chambers are positioned facing each other, after these doors have been locked together, and after these two doors have been opened.

FIG. 2 is a part view in section showing, on an enlarged scale, one embodiment of the means of sealing between the two doors.

DETAILED DESCRIPTION OF THE INVENTION

Figure 3:
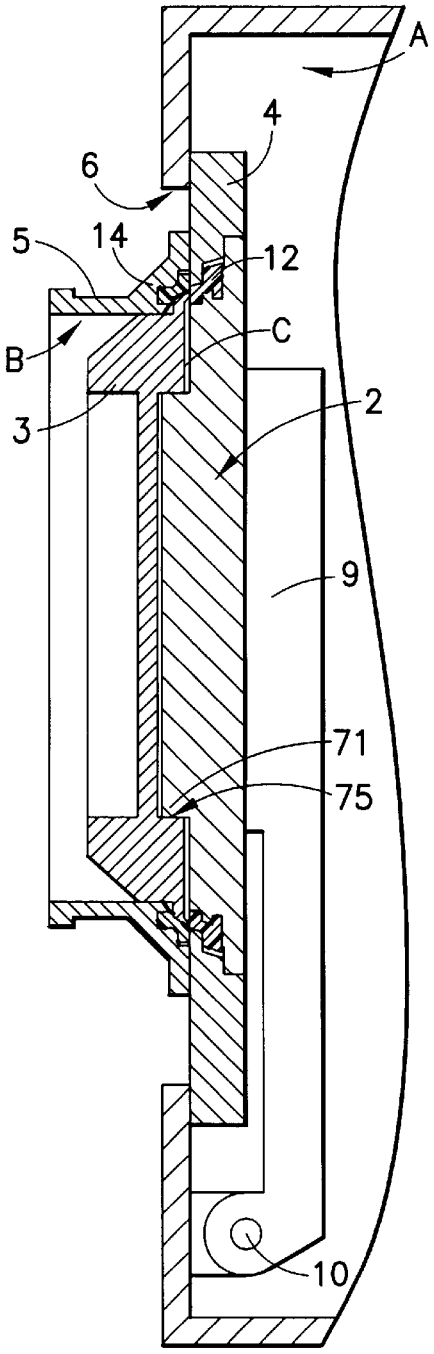

The invention relates to a connecting device that forms part of a more complex joining device in accordance with the state of the art, and which will initially be described hereafter with reference to FIGS. 1 to 7 before any introduction to and explanation of the present invention is given.

Such sealed joining devices are commonly used in many fields of industry and research, practically each time it is necessary to isolate a determined zone in order to form a confinement chamber, either because of the dangerous or contaminating nature of the atmosphere or of the products contained in this zone, or, on the other hand, because the sterile atmosphere contained in this zone might become contaminated by the ambient air. Such situations arise in particular in the nuclear, electronic, pharmaceutical and medical fields.

The invention therefore relates more specifically to a device, which is being described at this stage because it forms part of the state of the art, in which the temporary coupling of the doors 2 and 3 each borne by a stationary frame in the form of a flange 4 and 5 respectively, forms a chamber "C". One of these doors, namely the door 2, is arranged on the opening 6 of a stationary chamber "A" isolated from the external medium, while the other door, namely the door 3, is arranged in the opening of another chamber "B", also isolated from the external medium. The invention relates more specifically, although not exclusively, to the application of this device to the connecting-together of a sterile chamber "A" and a transportable or mobile chamber "B", for example consisting of a transportable container formed by a casing made of synthetic material 8 fixed to the flange 5 of the door 3.

With this sealed joining device, the stationary chamber "A" is closed by a door 2, generally circular, borne by an arm 9 articulated about an axle 10, for example vertical, with respect to the flange 4. This door has sealing means, such as a compressible annular seal 12 cooperating with a bearing surface 11 of the flange 4 or vice versa.

Likewise the transportable chamber "B" is closed by a door 3, generally circular but of smaller diametral size than the opening formed in the flange 4 for the door 2 of the stationary chamber, so that it can fit through this opening. The door 3 has means of sealing with its flange 5, namely a compressible annular seal 14 borne by the flange and cooperating with a bearing surface 15 of the door 3, or vice versa.

Figure 5:
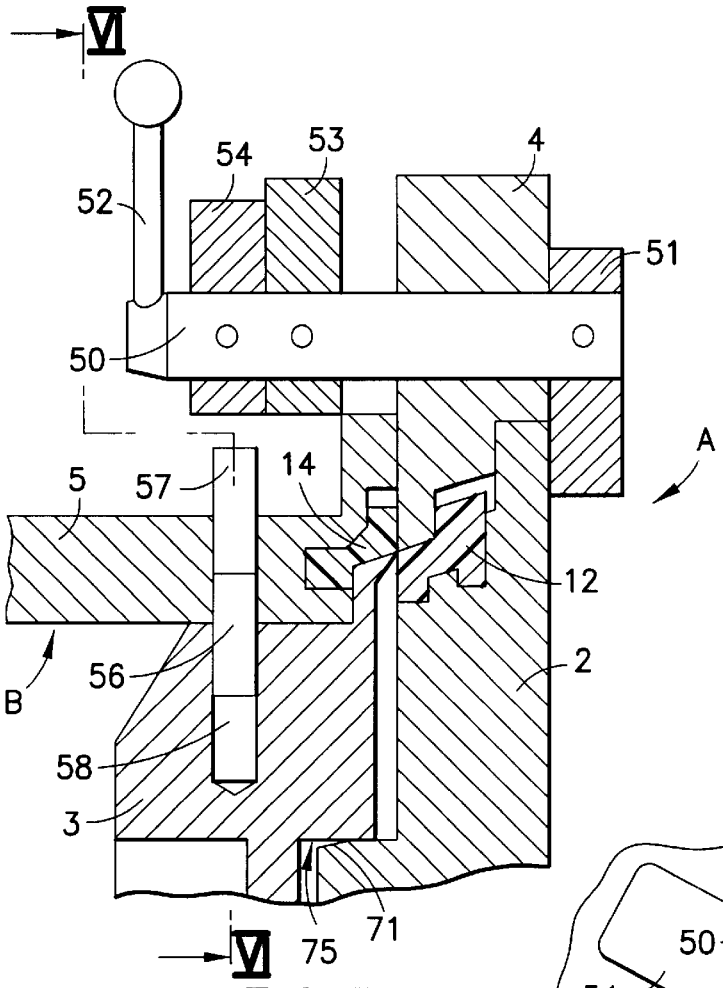
FIG. 5 is a part view in section on V—V of FIG. 6 showing, on an enlarged scale, one embodiment of the means of locking the flanges together and of the means of locking each door to its flange.

Each of the doors 2 and 3 is also associated with means of locking it to its flange in the closed position. In the embodiment depicted in FIGS. 5 and 6, defined hereafter, these locking means comprise a shaft 50 mounted so that it can rotate freely in a bearing of the flange 4, a rotary latch 51 wedged onto that end of the shaft that is located in the chamber A, and a lever 52 wedged onto that end of the shaft 50 which extends outside the chamber A. The rotary latch 51 is in the form of a blade and can occupy either a position in which, as shown in FIG. 5, it presses the door 2 into a recess in the flange 4, or a positionin which it is radially outside this door, to allow this door to move.

Figure 6:
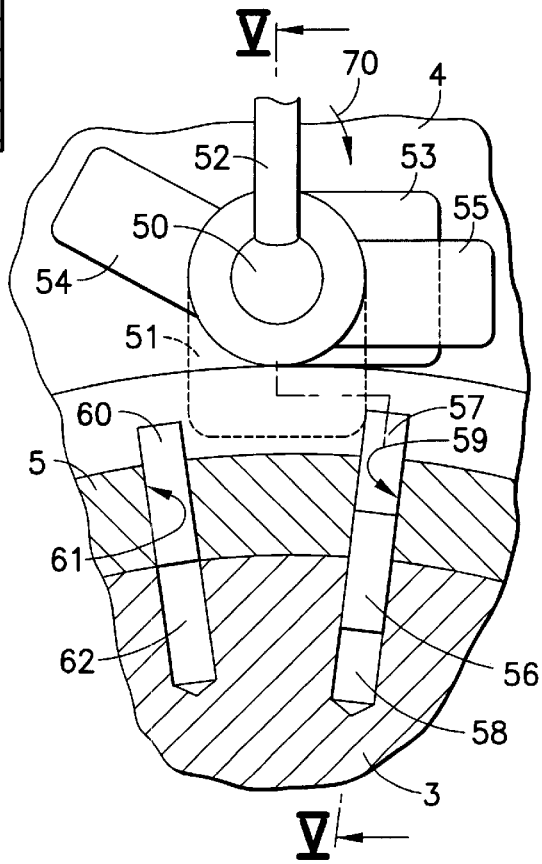
FIG. 6 is a view in part section of VI—VI of FIG. 5.

The shaft 50 also bears, wedged on it and from the outside of the flange 4 towards the lever 52, on the one hand, another rotary latch 53 which can wedge the flange 5 against the flange 4 and, on the other hand, two radial fingers 54 and 55 capable of cooperating with the means of wedging the door 3 on its flange 5. FIG. 6 shows that these various elements 51, 53, 54 and 55 are angularly offset with respect to one another and with respect to the lever 52.

The means of locking the door 3 to its flange 5 comprise two cylindrical pins 56, 57 engaged, as a tight fit and one after the other, in, respectively, a blind bore 58 in the door 3, and a bore 59 coaxial with the first bore and formed radially in the flange 5. The pins are engaged only partially so that the pin 57 projects out from the flange 5 and so that the pin 56 cuts across the internal bore 5*a* of the flange 5 taking the door 3 so as to lock the door to its flange. If the container is a disposable container, then another pin 60, visible in FIG. 6, is arranged in a bore 61 of the flange, aligned with a blind bore 62 of the door 3. At the start, the pin 60 is in the position depicted in FIG. 6, that is to say extends radially from the flange 5 at one end, while its other end lies flush with the bore 5*a* without entering the blind bore 62. This pin 60 and the coaxial pins 56, 57 are angularly offset on each side of the diametral plane containing the axis of rotation of the shaft 50 and are arranged in the circular paths of the fingers 54, 55 borne by this shaft.

Such a device is generally associated with other similar devices angularly spaced around the periphery of the flange 4.

Figure 7:
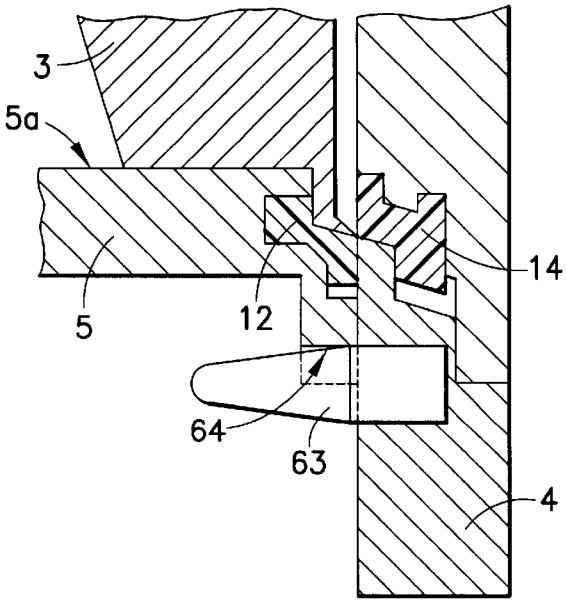
FIG. 7 is a part view in section showing, on an enlarged scale, one embodiment of the means of positioning the removable chamber on the stationary chamber.

Finally, to make the flange 5 of the removable chamber or container B easier to position with respect to the flange 4 of the stationary chamber A, and as shown in FIG. 7, the flange 4 is secured to several longitudinal fingers 63 projecting outwards and capable of cooperating with circular cutouts 64 made in the periphery of the flange 5.

When no transfer is taking place, each of the doors 2 and 3 is locked, to its respective flange 4 and 5, by the latches 51 and the pins 56. When the contents of one chamber need to be transferred into the other chamber, for example when the contents of the transportable chamber "B" have to be transferred into the stationary chamber "A", the flange 5 of the door 3 of the transportable chamber "B" is brought, as shown in FIG. 1, against the flange 4 of the door 2 of the stationary chamber "A", where it is approximately positioned by the fingers 63, then definitively by the engagement of a central boss 71 of the door 2 in a recess 75 of the door 3.

Turning the levers 52 in the direction of the arrow 70 of FIG. 6 simultaneously locks the flange 5 onto the flange 4, unlocks the door 2 via the rotary latch 51 and unlocks the door 3 from its flange 5 through the fingers 55 driving in the pins 56, 57: this driving-in action brings the zone of contact between the pins 56, 57 even with the bore 5*a* of the flange, and thus releases the door 3.

In this position, depicted in FIG. 3, the annular seal 14 borne by the flange 5 is in sealed contact against a circular bearing surface 13 of the flange 4 (FIG. 2), thus isolating from the external medium the inside of the zone of connection between the two chambers "A" and "B". Likewise, the other annular seal 12 is in sealed contact with the door 3, and more specifically with a circular ridge 16 thereof, thus isolating the gap between the two doors 2 and 3, that is to say the space "C". By virtue of this, the faces 17 and 18 of the doors, which hitherto were in contact with the external medium, are now confined within this space C, thus preventing the possibility of these faces subsequently contaminating the internal volume formed by the sealed union of the two chambers "A" and "B". In the case of the transfer of contaminating products, the confinement of this space also prevents the possibility of the two faces 17 and 18, which, after transfer, will once again be in contact with the outside, contaminating the external medium It is clear from the foregoing that the means of sealing between, respectively, the two flanges 4 and 5 and the two doors 2 and 3, define two circular and continuous so-called critical lines. C1, C2 of sealing, the integrity of which lines absolutely must be maintained in order to prevent any contamination by or of the external medium, and similarly by or of the space "C" (see FIG. 4).

The term "critical line" means, as is well known to those skilled in the art, a line with residual contamination by the medium external to the two chambers that have been brought into communication. After the two chambers have been coupled and brought into communication, this line is liable to come into contact with the atmosphere or fluid present in the passage formed between the two chambers, or into contact with the product or products passing through the said passage, and to contaminate them.

During these maneuvers, complementary connecting means described later and with which the exterior faces of the two doors 2 and 3 are equipped couple together and secure these doors together such that the movements of opening and closing the door 2 of the stationary chamber "A" are transmitted to the door 3 of the transportable chamber "B".

Figure 4:
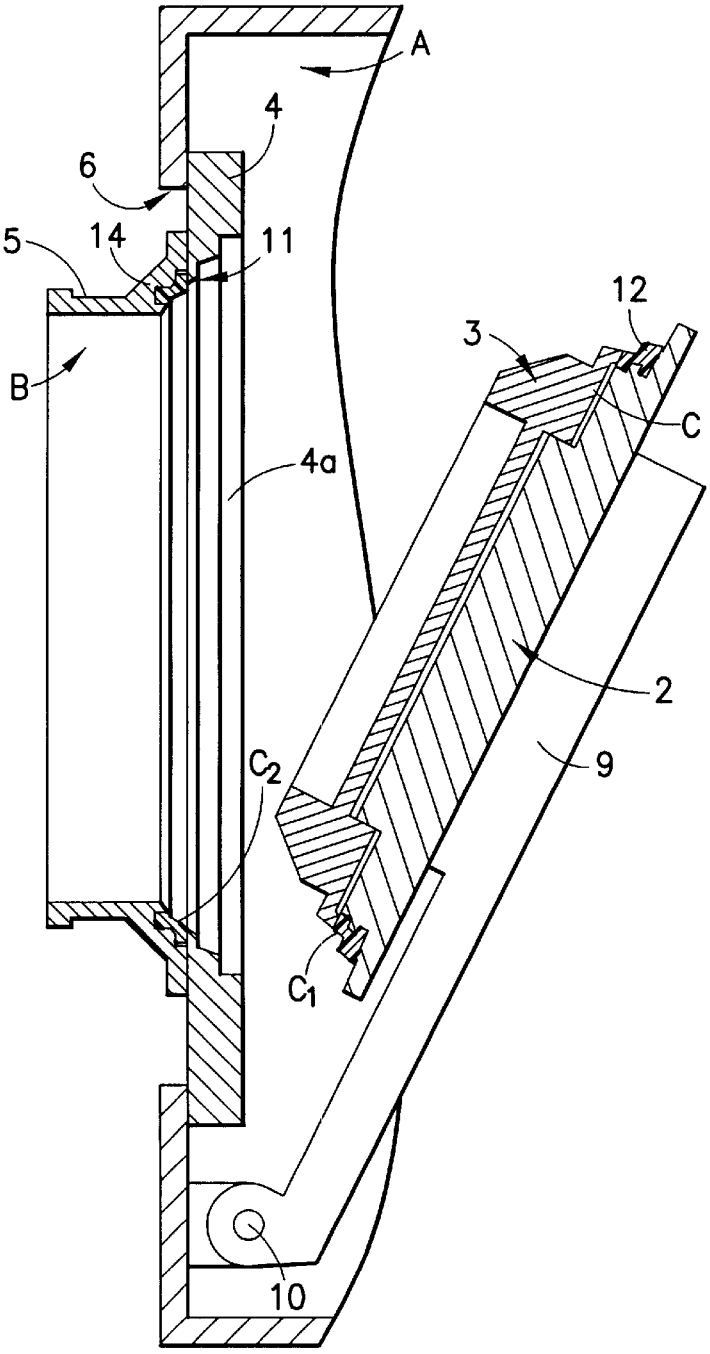

After the two doors 2 and 3 have been unlocked from their respective flanges 4, 5, the two chambers "A" and "B" can be brought into communication by pivoting the door 2 towards the inside of the stationary chamber "A", as shown in FIG. 4. This movement uncovers the opening 4a of the flange 4 and, because of the connection between the two doors 2 and 3, moves the door 3, which passes through this opening 4a and enters the stationary chamber "A".

After, for example, the contents of the transportable chamber "B" have been transferred into the stationary chamber "A", the doors are returned to the shut position.

Locking of the closure is then performed by turning the levers 52 in the opposite direction to the arrow 70 until the pins 60 are driven in by the fingers 54, if this chamber B is a disposable chamber, then by returning the levers to their central position depicted in FIG. 6, to allow the door 2 to be locked to its flange 4 by the rotary latches 51.

At this stage, both chambers A and B are once more hermetically closed and the chamber B can be removed by parting the critical lines and bringing into contact with the outside the faces which hitherto had been isolated therefrom.

For a more complete description of the sealed joining device, reference can be made, as required, to French Patent FR-A-2,721,289 in the name of IDC ISOLATEUR DENOMINATEUR COMMUN.

This method of sealed connection of two chambers isolated from the external medium is entirely satisfactory but can be improved as far as the temporary connection between the doors is concerned.

Thus, when this connection is provided by radial studs or bayonet pegs projecting from one of the doors and entering cutouts in the other door, the rotation needed for coupling and uncoupling the two doors is generally achieved by rotating the door of the transportable chamber "B", and for example the container with respect to the stationary chamber "A", something which is not always convenient and requires a human effort commensurate with the mass of this container. Furthermore, because of the friction of the circular sealed bearing surfaces on the corresponding seals, this rotation leads to wear which may generate contaminating particles or give rise to leaks that encourage bacterial or some other contamination.

Recourse to lubricants for reducing this wear also constitutes a source of contamination.

When, as described in document FR-A-2 721, 289, the connection between the two doors is made by adhesion or magnetically, for example by means of at least one small magnetic plate fixed in the central part of the exterior face of the door 2 of the stationary chamber "A", and by another, magnetic or ferrous, plate fixed to the exterior face 17 of the other door 3, the force of magnetic attraction generated between the two shutters is relatively low and depends on the manufacturing tolerances on these doors. Thus, it may be that this force of attraction is not strong enough to provide adequate compression of the seal 12 between the two doors by the circular bearing surface opposite, and therefore to make the sealed connection between these two doors. Likewise, upon opening, it may be, particularly when the transportable chamber B is at a partial vacuum, that the door 3 of this chamber "B" comes away from the door 2 of the stationary chamber "A", opening the chamber "C" and therefore giving rise to contamination of the interior volume of the two chambers "A" and "B", particularly contamination of the stationary chamber "A".

Document EP-A-0, 730,907 describes a device providing a connection between two doors comprising ducts which, formed in one of the doors and opening into a space formed between these two doors, can be connected to a source of vacuum in order to secure these two doors together before their phases of, respectively, coming away from their frame and pivoting to open.

Thus, as soon as the sealed connection between the two doors is made, evacuating the network of ducts, by creating a vacuum in the internal space delimited between the two doors, causes these two doors to be held closely together with a force which depends on the size of the areas facing each other and on the strength of the partial vacuum but which, in any case, may be much greater than the strength of a commonplace magnetic attraction force.

This method of connection also presents the following advantages:

- it requires no relative angular movement between two respective doors, and leads to no seal wear and therefore generates practically no contaminating particles, and does not require lubrication;
- by lengthening the life of the sealing means, it reduces the constraints associated with replacing them, which is a tricky operation;
- it is convenient and almost instant, because it is active as soon as the partial vacuum has been created in the network of ducts and in the internal space which are connected to the source of vacuum.

However, if the internal critical line of sealing between the two doors is broken as a result, for example, either of incorrect positioning, or of wear of the sealing means, and nonetheless allows the vacuum to provide the connection between the two doors, there is a risk of accidental contamination which is all the more detrimental because it is undetectable.

The object of the present invention is to remedy this by providing a device for connecting the doors of a device for sealed connection between two chambers which are isolated from the external medium, improving the security of the joint and of subsequent maneuvers while guaranteeing that the initial condition, for example the sterility, of the chambers "A" and "B" is preserved.

To this end, the connecting device according to the invention comprises, on ducting connecting the source of vacuum to the network of ducts formed in one of the doors, at least one sensor that measures the strength of the partial vacuum in this ducting and reacts on an alarm when this partial vacuum does not reach a displayed or stored value.

Each time a maneuver for joining two chambers together is made, the sensor carries out an automatic check on the connection between the doors and prevents any accidental contamination through lack of sealing. This considerably improves the safety with which any products or liquids are transferred between the two chambers.

Advantageously, one of the doors is equipped with a circular zone cooperating with a seal of the other door, and defining the internal critical line of sealing delimiting the internal space between the two doors, and the said door has, close to this circular zone, a recessed circular bearing surface limiting the relative axial displacement of the said door with respect to the other door and thereby ensuring the controlled compression of the corresponding seal Linder the action of the partial vacuum.

In one embodiment of the invention, the ducting conveying the vacuum to the network of ducts formed in one of the doors is also connected to a source of compressed air with the interposition of a multi-way electrically-operated valve capable, simultaneously, of isolating the ducting from the source of vacuum and from the branch with the sensor and of placing this ducting in communication with the source of compressed air so as to send into the space between the two doors, a flow of pressurized air to encourage these doors to part.

This simple and inexpensive arrangement makes it possible to avoid having to detach the door of the mobile chamber B when it has remained stock to the door of the chamber A, for example, when the door of the chamber B has not been completely locked in its stationary frame prior to the removal of chamber B and has remained stuck, while its chamber is evacuated. It thus eliminates the need for levers or screwdrivers inserted between the door and the stationary door point in order to succeed in detaching the mobile door, with the accompanying risk of damaging the seal of the stationary door.

In the description which follows, the elements which are common to the invention and to the state of the art explained earlier will bear the sane reference numerals, new elements being referenced between 30 and 49 and from 72 onwards.

Figure 8:
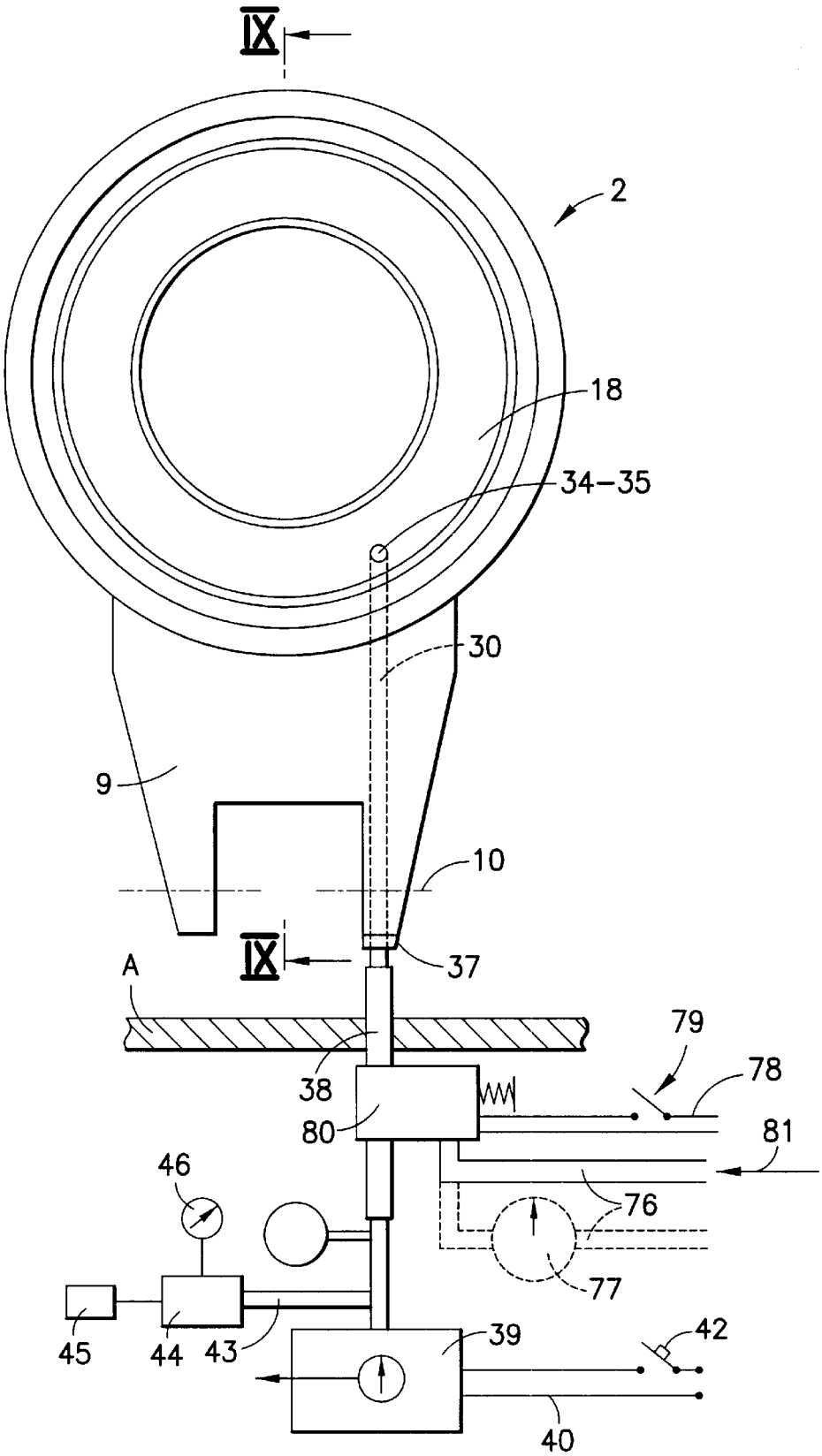
FIG. 8 is a front elevation of a door according to the invention.
Figure 9:
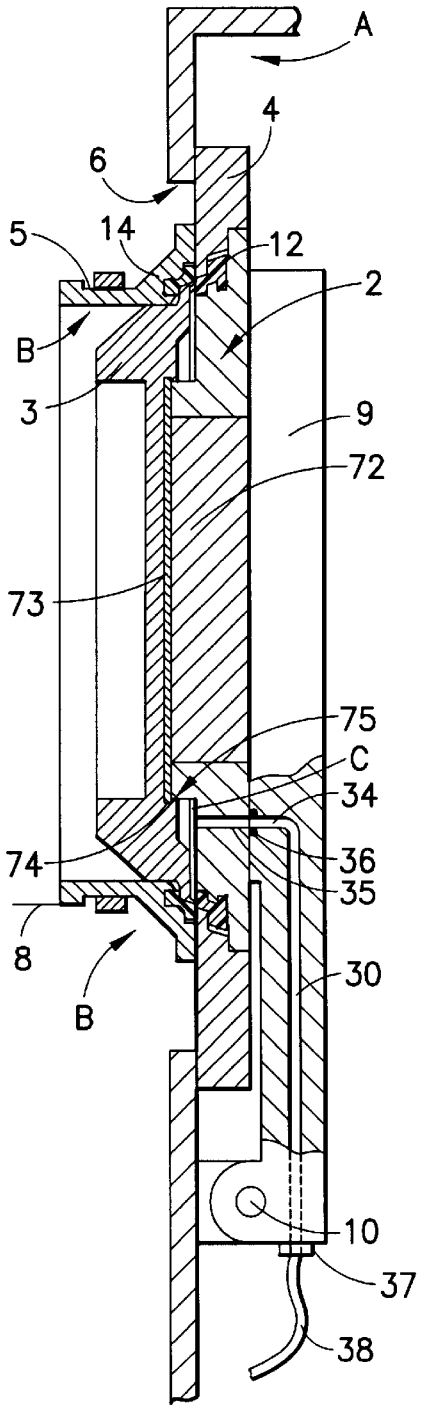
FIG. 9 is a view on IX—IX of FIG. 8, showing, on an enlarged scale, the door of FIG. 8 when in the phase of being connected to the door of a transportable chamber.

As shown in FIGS. 8 and 9, the door 2 has passing through it a network of ducts, comprising:

- in the arm 9, a longitudinal duct 30 communicating with a blind transverse duct 34 emerging from that face of the arm that is arranged against the door 2;
- and in the door 2, a duct 35 extending the aforementioned duct 34.

An O-ring 36 is arranged in the plane where the arm 9 meets the door 2, to avoid any leakage. The duct 35 emerges from the external fact 18 of the door 2 in that zone thereof which, when this door 2 is up against the door 3 forms the sealed internal space C that has to be isolated from the external medium.

The duct 30 communicates with a fitting 37 for connecting to ducting 38 leading to a source of vacuum 39, for example an electric vacuum pump preferably arranged outside the two chambers. The electric power supply circuit 40 for this pump comprises an operating member, such as a switch or circuit breaker 42, actuated manually or automatically. This switch is preferably arranged outside the two chambers "A" and "B", and, for example, is arranged on the external face of the stationary chamber "A", close to the means of controlling the locking of the flanges.

The ducting 38 is also connected, via a tapping 43, to a sensor 44 of the vacuum gauge or some other type, measuring the strength of the partial vacuum in the pneumatic circuit and reacting, via pneumatic or electrical means, on an alarm 45. The sensor 44 can also be connected to an apparatus 46 for measuring the partial vacuum, of mechanical or electrical type.

Figure 10:
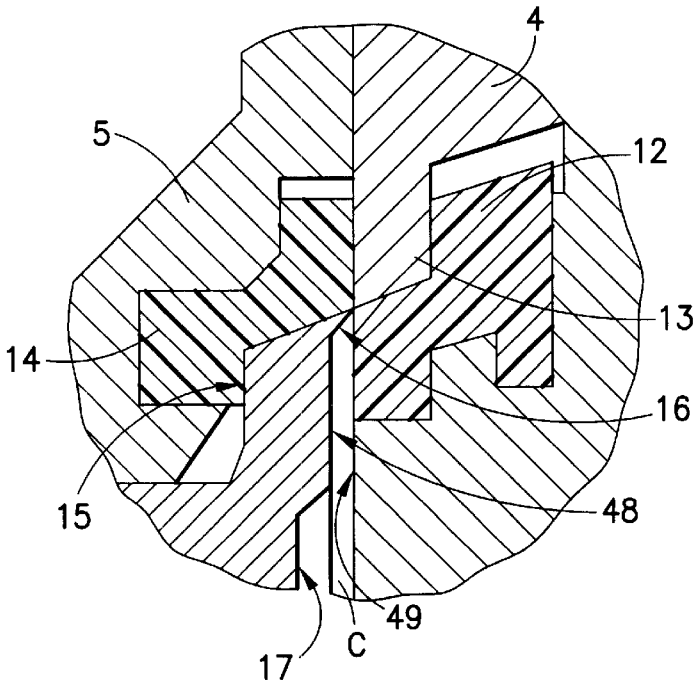
FIGS. 10 and 11 are part views, in cross section, showing on an enlarged scale, one embodiment of the sealing means according to the invention, delimiting the internal space between the two doors.
Figure 11:
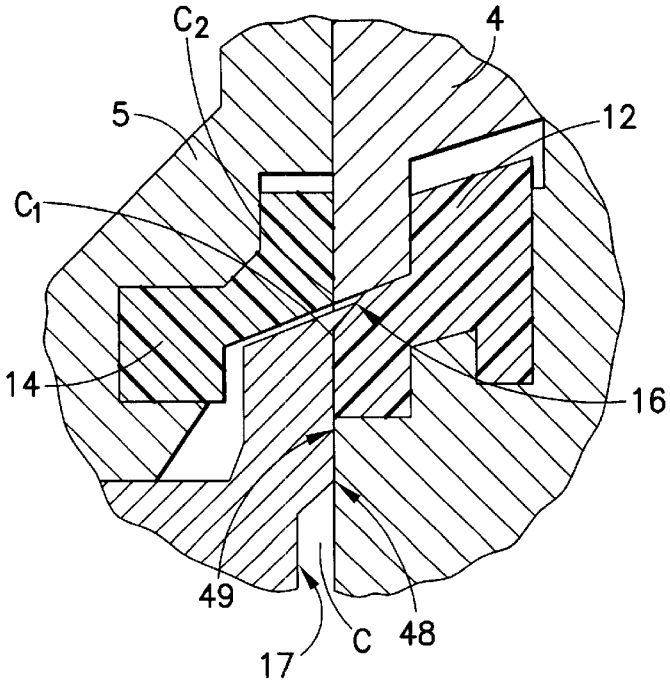

According to another feature of the invention, shown in greater detail in FIGS. 10 and 11, the circular ridge 16 of the door 3 cooperating with the seal 12 of the door 2 and defining the internal critical line C1 of sealing of the internal space "C" is formed on the periphery of the external face 17 of this door 3 and is juxtaposed with a circular bearing surface 48, the utility of which will be explained later.

The connecting device does not become involved in the maneuver of locking the two doors 2 and 3 together until after the flanges 4 and 5 have been locked together, sealing the connection from the external medium by the compression of the seal 14 as described in the preamble of this description. At this stage, and as shown in FIG. 10, the circular zone 16 of the door 3 has already come into contact with the seal 12 of the door 2, whereas the adjacent circular bearing surface 49, opposite it, of the door 2.

As soon as the switch 42 is actuated to switch on the vacuum pump 39, the ducting 38 and the network of ducts 30, 34 and 35 cause a partial vacuum in the gap "C" between the two doors 2 and 3, and this has the effect of causing the door 3 to shift axially over a very short distance (highly exaggerated in FIG. 11) until its bearing surface 48 comes into contact against the bearing surface 49, opposite it, of the door 2. In this position, and as shown in FIG. 11, the circular zone 16, defining the internal critical line C1 specific to the internal space "C" compresses that part of the seal 12 of the door 2 that is opposite, and guarantees that this critical line of sealing is achieved. At the same time, the partial vacuum created in the space "C" makes sure that the two doors 2 and 3 are connected. Actuation of the switch 42 may be manual or automatic, for example, if it is placed in the path of the pivoting of one of the levers 52.

The partial vacuum in the pneumatic circuit leading from the pump 39 to the space C is measured by the sensor 44. If the strength of this does not reach a reference value corresponding to the desired sealing of the bearing surface 16 against the seal 12, as a result either of incorrect positioning or of a leak owing to wear or an undesirable presence, then the sensor 44 reacts on the alarm 45 to inform the operator that he must not continue with the maneuver of bringing the two chambers "A" and "B" into communication.

The sensor 44 can also react on electric, electronic or electromechanical means preventing this bringing into communication, for example by locking the door 2 of the stationary chamber A.

This sensor therefore guarantees that these chambers or the external medium, if it is these chambers which are contaminating, is or are kept in the initial state. This check on the integrity of the moving critical line is particularly advantageous because it considerably improves the safety of the maneuver for the sealed connection of the chambers "A" and "B".

The sensor 44 may also be used when connecting two chambers A and B, particularly in the context of a pneumatic circuit self-test procedure consisting in creating a partial vacuum in the circuit in order to check either that this circuit is not blocked or that the said sensor is operating correctly.

Although the device for connection by partial vacuum according to the invention can be used on its own, it may be advantageous to combine it with a magnetic connection device, even if only to temporarily secure the doors 2 and 3 together after these have been positioned in their relative angular positions, but prior to the maneuvers of locking the flanges 4 and 5 and therefore unlocking the doors 2 and 3, as mentioned earlier.

A magnetic connection device comprises, as shown in FIG. 9, a magnet 72 arranged inside the central boss of the door 2 of the stationary chamber "A". This magnet is intended to cooperate with a small metal plate 73 made of ferrous material, held in a groove 74 of a recess 75 formed in the door 3, opposite the aforementioned central boss.

In an embodiment depicted in FIG. 8, the ducting 38 is also connected, with the interposition of a multi-way electrically-operated valve 80, to a branch 76 connected either to a source 81 of compressed air or to an electric air pump 77. The electric powersupply circuit 78 of the electrically-operated valve comprises a contact 79.

If, in the door-closing maneuver, the operator incorrectly locks the door 3 onto its stationary frame 5 and, having closed and locked the door 2 onto its frame 4 and extracted the chamber B, the door 3 remains stuck to the door 2, then in order to release it, all that is required is for the contact 79 to be actuated. This operation can be performed by specific human intervention or through automatic action, for example associated with actuation of the unlocking levers. The electrically-operated valve 80 then isolates the ducting 38 from the source 39 of vacuum and from the branch 45 equipped with the vacuum gauge 44 and places this ducting 38 in communication with the source of compressed air. Pressurized air thus enters the space C and exerts on the door 3 a force which encourages it to come away from the door 2.

This arrangement does not occur during the joining maneuver but, by making the doors easier to part and by eliminating any need for tools for performing this separation, contributes to preserving the integrity of the seals and therefore the integrity of the critical line of sealing.

What is claimed is:

1. Device for connecting doors which provides a sealed connection of a first stationary chamber and a second removable and transportable chamber which are isolated from an external medium and at least one of which has contents therein, wherein in said device:

each chamber has at least one access opening equipped with a door (2, 3) cooperating with sealing means (12, 14) and a flange (4, 5) forming a stationary frame, one door (2) being articulated to its flange (4);

each door (2, 3) having means of locking to their respective flanges (4, 5) and complementary connecting means which, before the contents of one of the first and second chamber have been transferred into the other one of the first and second chamber, and while the flanges (4, 5) are locked together in a sealed manner, allow the doors (2, 3) to be connected thereby forming, through contact of sealing means (12, 16 and 13, 14), an internal space "C" isolating their faces (17, 18) now in contact from the external medium; and external means for controlling locking-together of the flanges (4, 5) and external means for controlling the unlocking of the doors (2, 3) from their flange;

wherein the means of connection between the doors (2, 3) made up of a network of ducts (30, 34, 35) formed in at least one door, opening into internal space "C" and connected to a source (39) of vacuum to create at least a partial vacuum in the network of ducts (30, 34, 35), characterized in that the means of connection comprises, on ducting (38) connecting the source (39) of vacuum to the network of ducts (30, 34, 35), a sensor (44) that measures the strength of the partial vacuum in the network of ducts (30, 34, 35) and reacts on an alarm (45) when this partial vacuum does not reach a predetermined value.

2. Device according to claim 1, characterized in that one door (3) is equipped with a circular zone (16) cooperating with a seal (12) of the other door (2) and forming an internal critical line of sealing with respect to the space "C" formed between the doors (2, 3), and the one door (3) has, close to the circular zone (16), an internal and recessed circular bearing surface (48) limiting the displacement of the one door (3) with respect to the other door (2) and therefore compression of the corresponding seal (12) under the action of the partial vacuum.

3. Device according to claim 1, characterized in that the ducting (38) conveying the vacuum to the network of ducts (30, 34, 35) formed in one door (2 or 3) is also connected to a source of compressed air (81 or 77) via a multi-way electrically-operated valve (80) capable, simultaneously, of isolating the ducting (38) from the source of vacuum and from a branch (45) with the vacuum gauge (44) and of placing the ducting (38) in communication with the source of compressed air (81 or 77) so as to send into the space "C" between the doors (2, 3) a flow of pressurized air to encourage these doors to part.

* * * * *